US011185144B2

(12) United States Patent
Castex et al.

(10) Patent No.: US 11,185,144 B2
(45) Date of Patent: Nov. 30, 2021

(54) DEVICE FOR DISPENSING A COSMETIC OR CARE PRODUCT COMPRISING SOLID ELEMENTS THAT ARE BROKEN DURING DISPENSING

(71) Applicant: CHANEL PARFUMS BEAUTE, Neuilly-sur-Seine (FR)

(72) Inventors: Nicolas Castex, Colombes (FR); Floriane Peronne, Paris (FR); Antoine Cayron, Forest (BE)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 0 days.

(21) Appl. No.: 16/633,851

(22) PCT Filed: Jul. 20, 2018

(86) PCT No.: PCT/FR2018/051864
§ 371 (c)(1),
(2) Date: Jan. 24, 2020

(87) PCT Pub. No.: WO2019/020913
PCT Pub. Date: Jan. 31, 2019

(65) Prior Publication Data

US 2020/0229576 A1 Jul. 23, 2020

(30) Foreign Application Priority Data

Jul. 26, 2017 (FR) ..... 1757087

(51) Int. Cl.
*B65D 83/00* (2006.01)
*A45D 34/04* (2006.01)
(Continued)

(52) U.S. Cl.
CPC ..... *A45D 34/04* (2013.01); *A45D 40/26* (2013.01); *A45D 2200/055* (2013.01);
(Continued)

(58) Field of Classification Search
CPC .. A45D 34/04; A45D 40/26; A45D 2200/055; A45D 34/00; A45D 40/04;
(Continued)

(56) References Cited

U.S. PATENT DOCUMENTS 2,135,237 A * 11/1938 Lewis ..... B65D 47/2037 222/490
5,284,275 A 2/1994 Shomer
(Continued)

FOREIGN PATENT DOCUMENTS

DE 10-2015-106414 10/2016
FR 2994536 2/2014
(Continued)

OTHER PUBLICATIONS

International Search Report issued in International Patent Application No. PCT/FR2018/051864, dated Oct. 16, 2018; and English-language translation thereof.

*Primary Examiner* — David J Walczak
(74) *Attorney, Agent, or Firm* — Greenblum & Bernstein, P.L.C.

(57) ABSTRACT

Dispensing device for a cosmetic product stored in heterogeneous form including solid elements in suspension. The device includes a reservoir, a dispensing tip, a guide duct for transporting the product between the reservoir and the dispensing tip, and a product flow inducer configured to cause product flow from the reservoir to the dispensing tip. The guide duct includes a solid elements rupture configured to rupture the solid elements. The solid elements rupture includes a first stage at an exit from the reservoir forming a first portion of the guide duct and includes a changing transverse cross-section that has, at the exit, edges projecting within the guide duct. A second stage, near the dispensing tip, forms a second portion of the guide duct having a progressing cross-sectional restriction. The invention also
(Continued)

relates to an assembly that includes such device and a cosmetic or care product that includes solid elements in suspension.

10 Claims, 5 Drawing Sheets

(51) Int. Cl.
*A45D 40/02* (2006.01)
*A45D 40/26* (2006.01)

(52) U.S. Cl.
CPC ..... *B65D 83/0011* (2013.01); *B65D 83/0016* (2013.01); *B65D 83/0044* (2013.01)

(58) Field of Classification Search
CPC ..... A45D 2200/054; A45D 2200/10; B65D 83/0005; B65D 83/0011; B65D 83/0016; B65D 83/0027; B65D 83/0044; B05C 17/005; B05C 17/00503
USPC ..... 401/171, 172, 173, 174, 178, 75, 68, 82
See application file for complete search history.

(56) References Cited

U.S. PATENT DOCUMENTS

| | | | | |
|---|---|---|---|---|
| 6,315,483 | B1 * | 11/2001 | Velliquette ..... | A46B 11/0041 224/490 |
| 7,878,728 | B2 * | 2/2011 | Nasu ..... | B65D 83/0011 401/265 |
| 2009/0283545 | A1 | 11/2009 | Kimball | |
| 2015/0209810 | A1 | 7/2015 | Bibette | |

FOREIGN PATENT DOCUMENTS

| | | | | |
|---|---|---|---|---|
| FR | 2994536 | A1 * | 2/2014 | ..... B05B 15/30 |
| JP | 2002/192005 | | 7/2002 | |
| WO | 2012/145003 | | 10/2012 | |

* cited by examiner

DEVICE FOR DISPENSING A COSMETIC OR CARE PRODUCT COMPRISING SOLID ELEMENTS THAT ARE BROKEN DURING DISPENSING

The invention concerns the field of devices for dispensing and applying a cosmetic or care product.

Cosmetic products encompass all make-up products for the skin or superficial appendages as well as perfuming or odoriferous compositions for application to the body.

Care products comprise in particular products for application to the human or animal body to prevent or treat a pathology.

The invention relates in particular to a device for dispensing and applying such a cosmetic or care product taking a liquid, semi-fluid or pasty form.

The invention has a particular advantage for the application of a heterogeneous mixture containing solid elements that are dispersed, in suspension. Such a mixture may for example comprise solid particles or beads that may comprise a liquid core surrounded by a jellified membrane. For example, certain cosmetic or care compositions comprise active ingredients, essences or other ingredients so encapsulated.

The particles or beads of such a heterogeneous mixture must however be ruptured in order to release their content during the dispensing of the mixture, that is to say either on application of the mixture on the user, or just prior to that application for example during the migration of the mixture between a reservoir and an applicator.

If required, the content of the particles or beads must be homogenized with the rest of the mixture.

Such fluids may be dispensed, in known manner, by means of pumps having a high suction capacity or using an airless pump.

These pumps however have the drawback of being relatively costly, and may prove unsuitable for the suction of a solution containing solids in suspension. Thus, the solids in suspension may block the pump and damage it, rendering the dispensing device inoperable.

It has been envisioned in the state of the art to equip dispensing devices with filter or grid type members, configured to break, grind and/or mix the solid elements in suspension in a heterogeneous liquid or pasty composition. Document U.S. Pat. No. 5,284,275 presents a member for delivery of an adhesive composition formed by the mixture of beads of a first product within a second product. The member described comprises a filter wall perpendicular to the direction of flow of the product within the delivery member. A piston enables the beads to be pushed through the filter wall, which ruptures them. Such a device is however easily subject to clogging of the filter wall.

One dispensing means, which partly solves this problem, is moreover disclosed in document FR2994536. The device disclosed in this document comprises a guide duct for guiding the composition to dispense, provided with a filter member comprising a filter member having a filter wall which is typically conical, thereby forming a non-zero angle with the axis of the guide duct.

The filter member, under the pressure of a piston, makes it possible to induce the rupture of the membranes of the beads which come to interfere with the filter wall at the location of the openings they comprise.

Nevertheless, although such a filter member may enable a large amount of product to be delivered, it does not ensure that all the beads (or other solid elements), or even a majority of the beads contained in the composition are ruptured on passage through the filter member.

A dispensing device comprising such a filter member is thus of low suitability for the dispensing of certain products for which it is necessary to ensure that a certain majority percentage of the beads has burst prior to application of the product. This is for example the case for lipstick or lip gloss (generally designated by the term "gloss"), since the final application by the user to the lips does not enable rupture of the beads which were not ruptured prior to the application.

The invention is directed to providing a device for dispensing a liquid or pasty cosmetic or care product that is initially heterogeneous, comprising solid elements in suspension, making it possible to maximize and make reliable the amount of solid elements ruptured on dispensing the product, and to homogenize the product, while limiting the risk of clogging.

Thus, the invention relates to a device for dispensing a liquid, semi-fluid or pasty cosmetic or care product, stored in heterogeneous form comprising solid elements in suspension which can be ruptured mechanically to release a fluid they contain, comprising a reservoir configured for storing the product, a dispensing tip for dispensing the product, a guide duct enabling the transport of the product between the reservoir and the dispensing tip, and means configured to induce the flow of the product from the reservoir to the tip, via the guide duct, the guide duct comprising a device for rupturing the solid elements. The device for rupturing solid elements comprises a first stage, at an exit from the reservoir, forming a first portion of guide duct and comprising a changing transverse cross-section having at an exit edges projecting within said guide duct, and a second stage, near the dispensing tip, forming a second portion of the guide duct and having a progressive restriction of cross-section.

The applicant has found that a device for rupture of solid elements comprising two stages, of which each stage induces the rupture of said elements in different modes, makes it possible to obtain the rupture of the majority, or possibly of practically all or all, of the solid elements passing through that rupturing device.

As the stages of the rupturing device form portions of the guide duct for the product between the reservoir and the tip for dispensing the product, the risk of clogging of the device is limited, as well as the loss of pressure induced by the device for rupturing solid elements, this fact enabling easy dispensing of a high amount of product.

The device may further comprise, downstream of the second stage of the rupturing device, a non-return valve. The non-return valve may have an outlet mouth for the product of cross-section less than the exit cross-section of the first stage and less than the most restricted cross-section of the second stage.

The exit cross-section of the first stage is for example star-shaped.

The cross-section restriction of the second stage may for example be a restriction comprised between 50% and 95% of the area of the entry cross-section of the second stage.

The second portion of the guide duct, formed in the second stage of the rupturing device, may be of cone frustum shape.

The device may comprise an elongate hollow rotary body and an elongate hollow outer barrel which are butted to each other, and rotatable relative to each other, the dispensing tip being fastened at an end of the rotary body, said rotary body and outer barrel forming an inner volume in which are provided: a bored cylinder, comprising the guide duct, and an inner barrel, comprising ah open end by which is inserted the bored cylinder, and an end which is closed so as to form the reservoir. This device may comprise a mechanism for transforming rotation of the rotary body relative to the outer barrel into a translational movement of the inner barrel relative to the bored cylinder inside the inner volume formed by said rotary body and outer barrel. The device may further comprise a piston fixedly mounted at one end of the bored cylinder inserted through the open end of the inner barrel and an elongate portion forming a portion of the guide duct in the bored cylinder, in which the piston comprises a central opening forming the first stage of the rupturing device.

The invention also relates to an assembly comprising a device such as described above, and a cosmetic or care product comprising solid elements in suspension, which can be ruptured mechanically to release a fluid they contain, said cosmetic or care product being stored in the reservoir of the device.

In such an assembly, the solid elements may be substantially spherical beads of diameter more than the maximum dimension of the most restricted cross-section of the second stage.

Still other particularities and advantages of the invention will appear in the following description.

In the accompanying drawings, given by way of non-limiting example:

FIG. 1 shows a device in accordance with an embodiment of the invention. FIG. 2 moreover represents an exploded view of the device of FIG. 1, which details the constituent parts and enables the assembly to be apprehended.

Figure 1:
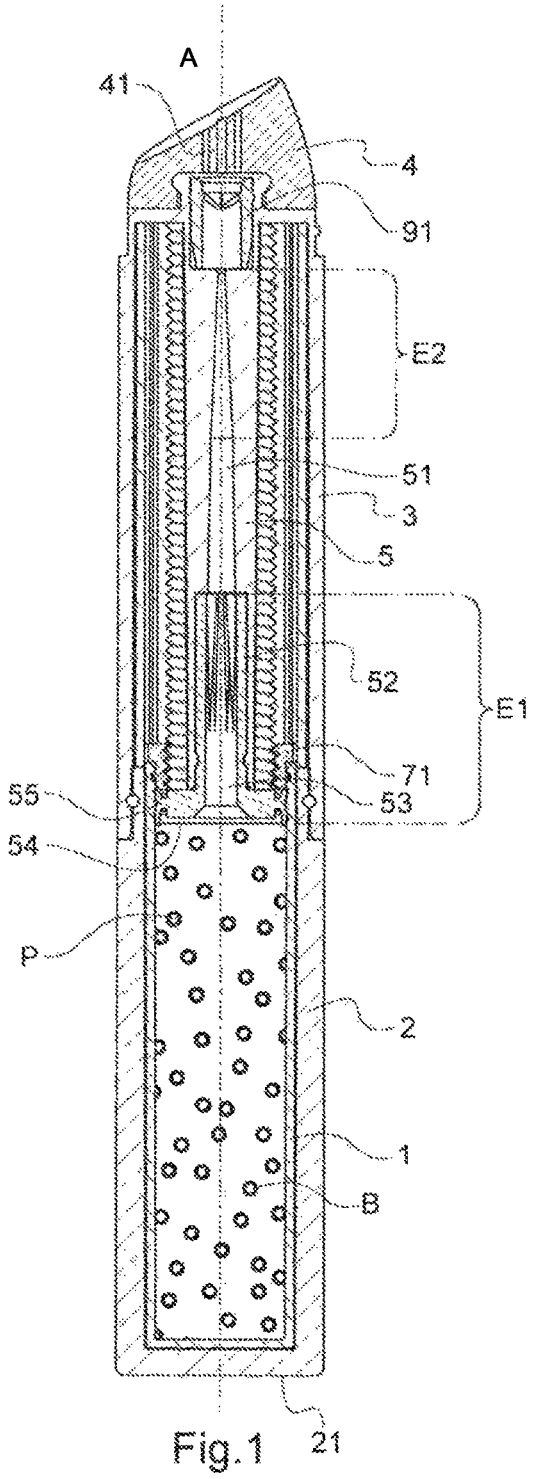
FIG. 1 shows a product dispensing device in accordance with an embodiment of the invention, in a diagrammatic cross-section view.

The device enables the dispensing and application of a fluid, semi-fluid or pasty cosmetic or care product P. The product P is said to be heterogeneous, in that it comprises solid elements B in suspension. The solid elements B may be mechanically ruptured to release a fluid they contain. The solid elements B may for example be beads comprising a jellified shell in which is contained one or more liquids, active ingredients, essences, essential oils, or other ingredients.

The solid elements B are in suspension in the product when it is stored in a reservoir 1 of the device, or may be put in suspension by shaking the device before use.

In the example of an embodiment represented here, the reservoir 1 is formed by a member referred to as inner barrel.

The inner barrel has the shape of a right cylinder closed at one end and open at the other.

The device comprises an outer barrel 2. The outer barrel 2 forms the lower part of the dispensing device. It is of elongate shape, and may have a cylindrical or prismatic outer shape. The outer barrel 2 comprises a bottom 21 able to comprise a closing wall. This air inlet may be formed through the bottom wall 21. The air inlet enables air exchange between the inside and the outside of the outer barrel 2. In particular, it enables the inlet of air to the outer barrel on movement, described below, of the inner barrel 1 within the outer barrel 2 during the dispensing of the product. The outer barrel 2 also comprises an opposite open face 22, into which is inserted the inner barrel 1. The inner shape of the outer barrel 2 matches the outer shape of the inner barrel, clearance being allowed for. This enables longitudinal translation, or in other words sliding of the inner barrel which forms a reservoir 1 within the outer barrel 2, along a main axis (A) of the device.

The outer barrel 2 is advantageously transparent or translucent, which enables the position of the inner barrel within the device to be seen. The position of the inner barrel in the device furthermore corresponds to a given amount of remaining product. In other words, seeing the position of the inner barrel enables the user to see the amount of remaining product, or conversely, the amount of consumed product.

If the inner barrel is itself transparent or translucent, the product can be seen directly. This provides aesthetic value, and furthermore enables the user to identify the desired product by its appearance, in particular its color, its brilliancy, and/or its other visual characteristics, such as the presence of the solid elements in suspension which may have an appearance providing aesthetic value, by their color, their brilliancy, their shape, etc.

The device also comprises a member which forms its upper part and which is referred to as rotary body 3. The rotary body 3 is of elongate shape, and may have a cylindrical or prismatic outer shape, and in particular an outer shape matching the outer shape of the inner barrel 2. The rotary body 3 is butted to the outer barrel 2. The rotary body 3 may be turned relative to the latter around the main axis (A) of the device.

The rotary body 3 is so designated because it constitutes the member which the user rotates, relative to the outer barrel 2, in order to induce the dispensing of cosmetic product by the device.

The rotary body 3 is hollow and thus defines, with the outer barrel 2 to which it is linked, an inner volume of the dispensing device.

In the example represented here, a dispensing tip 4 is fastened at the end of the rotary body 3. The dispensing tip 4 has an application surface 41, by which the cosmetic product P is dispensed and which enables application, for example in a thin and even layer on the skin of the user.

Within the inner volume formed by the rotary body 3 and the outer barrel 2, the device comprises not only the inner barrel but also the bored cylinder 5. The bored cylinder 5 comprises a longitudinal duct over the whole of its length, that is to say along the axis which it extends along which coincides with the main axis (A).

In the example represented here, the bored cylinder 5 is translationally fixed relative to the rotary body 3, inside which it extends. The bored cylinder 5 is fastened to the rotary body 3, and rotationally fixed relative to the latter.

The bored cylinder 5 is inserted into the inner barrel by its open end 22.

The device comprises a mechanism for transforming rotation of the rotary body 3 relative to the outer barrel 2 into translation movement of the inner barrel relative to the bored cylinder 5.

Thus, within the inner volume formed by said rotary body and outer barrel, it is the inner barrel 1 which is movable, while the bored cylinder 5 remains fixed longitudinally. On account of the movement of the inner barrel, the bored cylinder enters to a greater or lesser extent within said inner barrel, which varies the inner volume available in the reservoir 1 for the storage of the cosmetic product P.

A reduction in the available volume in the reservoir drives expulsion of a corresponding amount of the product P via the duct 51 of the bored cylinder 5.

The mechanism for transforming movement can have various configurations. These mechanisms may, as in the example represented here, be based on a threaded part (having a male or female screw thread) linked to the inner barrel, and on the fact that the assembly formed by the rotary body 3 and the bored cylinder 5 comprises a threaded part (female or male, correspondingly) configured to cooperate with the threaded part.

The rotation of said assembly formed by the rotary body 3 and the bored cylinder 5 drives the translation of said threaded component and of the inner barrel 1 within said rotary body 3, and as a corollary the translation of the inner barrel 1 relative to the bored cylinder 5.

Figure 2:
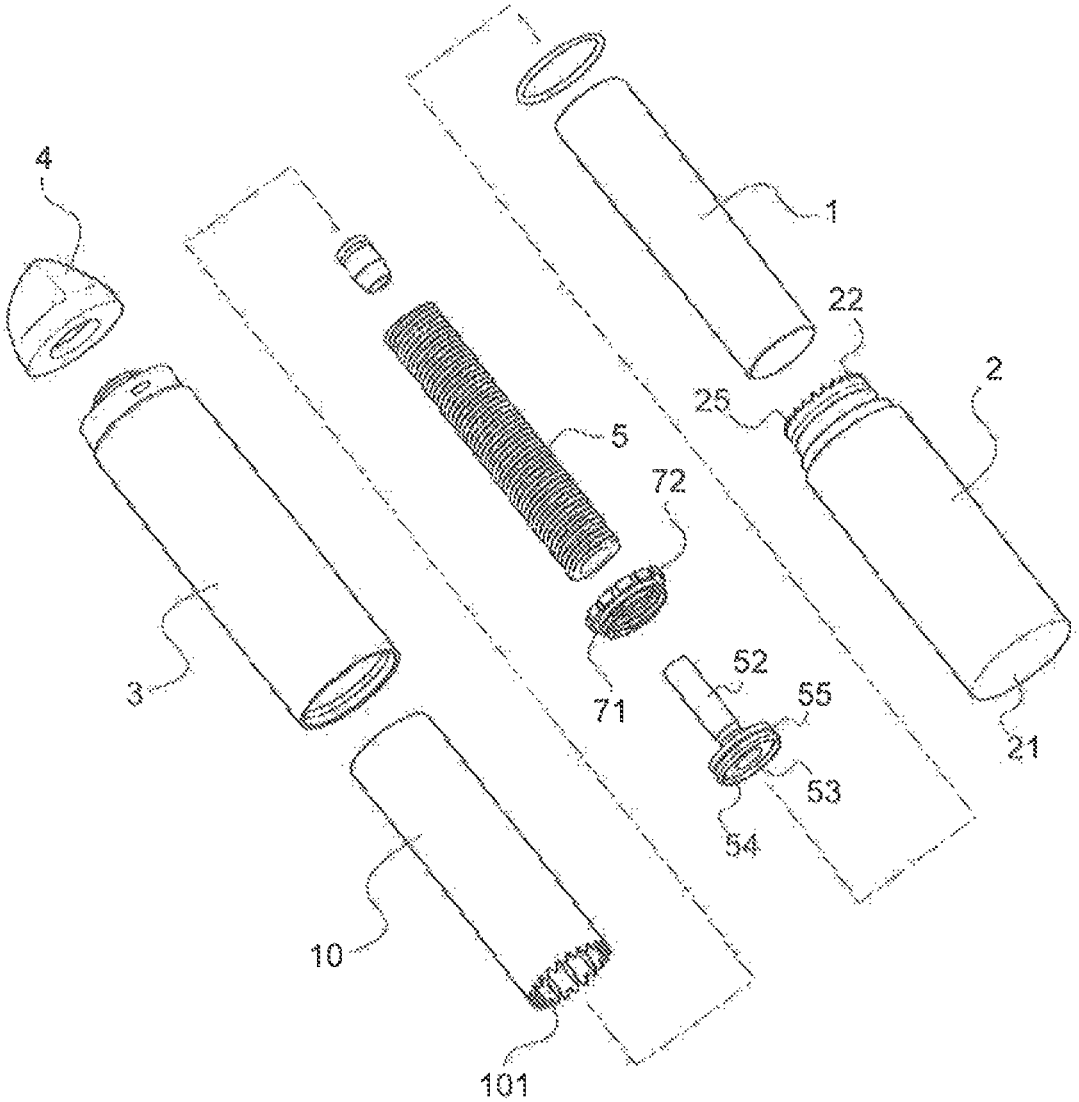
FIG. 2 shows an exploded view of the device of FIG. 1.

In the example of FIGS. 1 and 2, the threaded component is a ring 71 having an internal screw thread, referred to as female screw thread. The ring 71 is fastened to the open end 22 of the inner barrel, which it blocks off except at the location of its threaded opening.

On rising within the rotary body, the inner barrel rises along the bored cylinder 5, the effect of which is to reduce the inner volume available within the reservoir 1 for the product P, and to induce the expulsion of an amount of product P from the inner barrel via the duct 51 of the bored cylinder 5.

The device comprises a piston 52, which is fastened to the end of the bored cylinder. The piston 52 comprises a central opening 53 which communicates with the duct 51 so as to form a guide duct for the product P between the reservoir 1 and the dispensing tip 4.

The central opening 53 thus provides fluidic communication between a frontal surface 54 of the piston 52, which is in contact with the product P in the inner barrel 1, and the rest of the duct 51. The piston 52 is configured so as to have a peripheral surface 55 in sealing contact with the inner wall of the inner barrel.

In order to enable the translation of the ring along the threaded part of the hollow cylinder 5, said ring 71 must be free for translation relative to the outer barrel 2 and the rotary body 3 while being held rotationally fixed relative to the outer barrel 2. To that end, the device comprises a sleeve 10, extending within the rotary body, which is fixed relative to the outer barrel 2 and which has guides for translation of the ring 71.

Thus, the outer barrel 2 comprises a notched formation 25 on its upper part, which is configured to engage with a corresponding toothed formation 101 of said sleeve, which locks the sleeve 10 rotationally relative to the outer barrel 2. The sleeve 10 comprises grooves on its inner surface which are longitudinal, that is to say parallel to the main axis (A), along which the ring 71 is guided. The ring 71 may for this have, on its periphery, notches 72 (FIG. 2) which slide on longitudinal grooves.

Thus, when the inner barrel rises around the bored cylinder 5, the reduction in available volume in the inner barrel under the frontal surface 54 of the piston 52 drives the expulsion of an amount of product P corresponding to that reduction.

The product is expelled via the central opening 53 of the piston 52, then via the duct 51 of the bored cylinder, before reaching the application tip 4 which it passes through via dispensing orifices 42 before reaching the application surface 41.

Between its storage in the reservoir 1 and its dispensing, the product P passes through a device for rupturing solid elements. The device for rupturing solid elements is configured to rupture or burst the solid elements containing a fluid which are in suspension in the product P, which is stored in heterogeneous form in the reservoir 1, such that the fluid mixes with the rest of the product P just prior to its dispensing. A majority of the solid elements is ruptured by the device for rupturing solid elements, and the product distributed is thus relatively homogenous (however, in some variants of the invention, solid elements may remain that are not burst or are not fully ruptured).

The device for rupturing solid elements comprises at least two stages, that is to say a first stage E1 and a second stage E2. The device for rupturing solid elements is formed in the guide duct which comprises (or is constituted by) the central opening 53 of the piston 52 and the duct 51 of the bored cylinder 5. A rupturing device example, equipping the dispensing device of FIGS. 1 and 2, is in particular represented in the three-dimensional cross-section view of FIG. 3.

Figure 3:
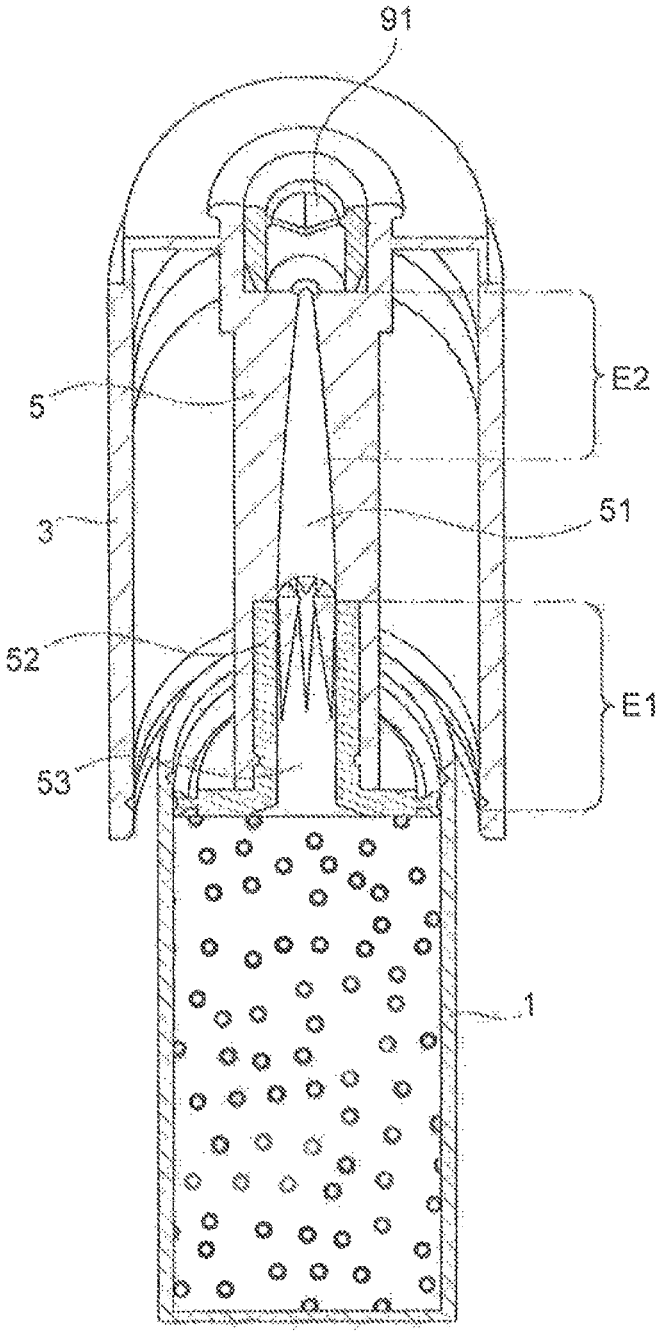
FIG. 3 represents certain members constituting the device of FIGS. 1 and 2, in a cut away diagrammatic view, in three dimensions.

In FIG. 3 there are only shown certain parts constituting a dispensing device as shown in FIGS. 1 and 2. In FIG. 3 there are shown:

the reservoir 1;
the rotary body 3;
the bored cylinder 5;
the piston 52; and
a non-return valve 91.

The piston 52, and in particular the central opening 53 of the piston 52 forms the first stage E1 of the device for rupturing solid elements. An end portion of the duct 51, which is proximal relative to the dispensing tip 4, forms the second stage E2 of the device for rupturing solid elements, FIG. 4, presenting a detail view of the piston 52, makes it possible, together with FIG. 3, to better understand the constitution of the first stage E1.

The first stage E1 of the device for rupturing solid elements is formed by the central opening 53 of the piston 52. The central opening 53 is a duct which extends in an elongate portion of the piston 52 inserted into the bored cylinder 5. It places the reservoir 1 in fluidic communication with the duct 51.

In the example shown here, the central opening has, at the location of the reservoir 1, an entry having a wide circular cross-section, enabling the free passage of the product P and in particular of the solid elements Bit comprises. The entry diameter of the central opening 53 is thus substantially greater than the maximum dimension of the solid elements 53 (for example the diameter of the solid elements B if in substance they are spheres).

Figure 4:
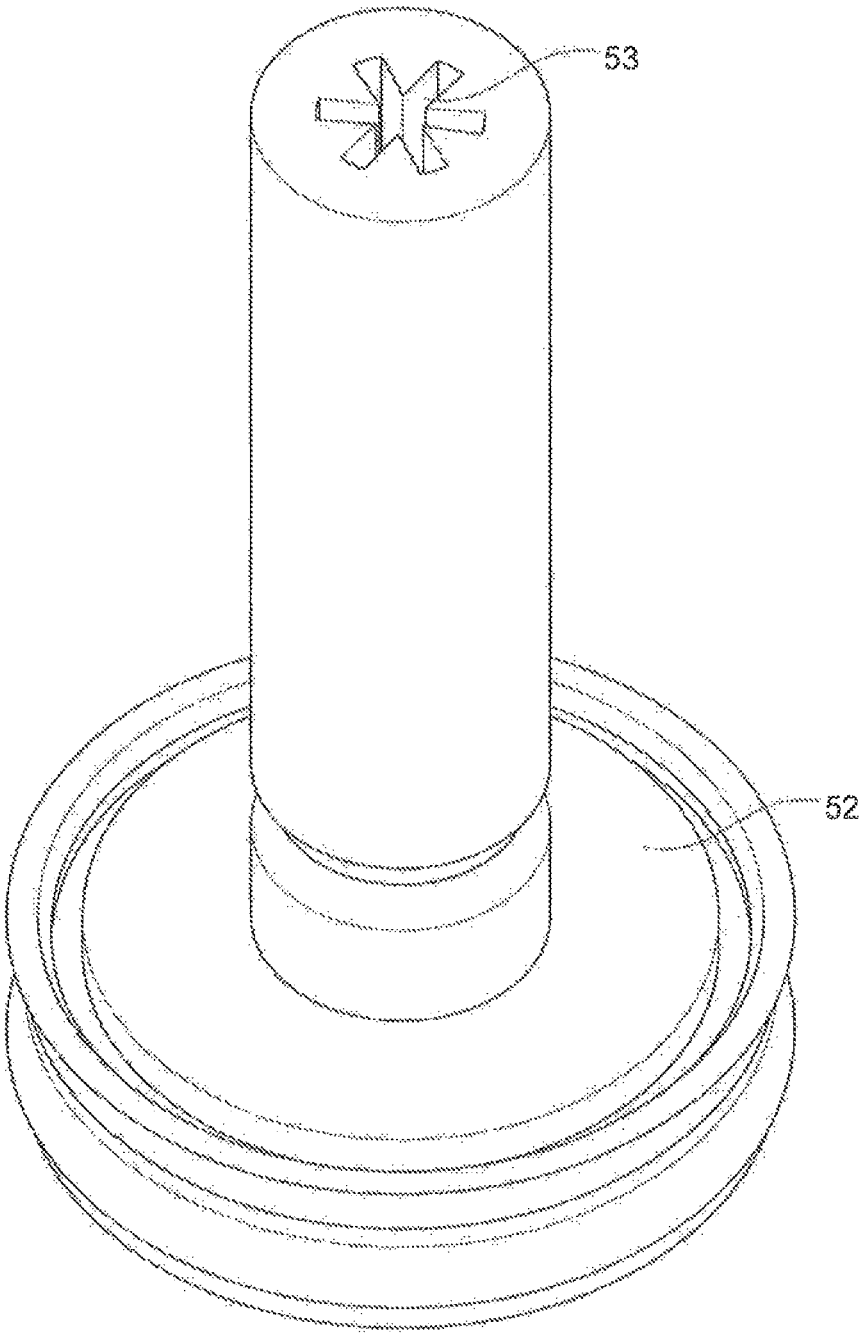
FIG. 4 represents an example of a first stage of a device for rupturing solid elements, in a diagrammatic view in three dimensions.

At an exit, the central opening 53 of the piston 52 is asterisk-shaped, as shown in FIG. 4. Numerous exit shapes may be envisioned for the first stage E1 of the device for rupturing solid elements, said shapes comprising edges projecting inside said guide duct. The possible shapes include those of stars, particularly for example stars with five, six, seven or eight triangular points. The possible shapes include crosses and asterisks with five or six limbs.

The change between the entry shape of the central opening 53 and the shape of its exit is preferably progressive, and extends over a portion or over the entirety of the length of the central opening 53.

The restriction of the exit cross-section makes it possible to accelerate the flow of product and to press the solid elements against the edges projecting into the central opening 53, which tends to rupture them, in particular to rupture their outer wall.

The second stage of the device for rupturing solid elements is constituted by a substantial restriction in cross-section of the guide duct. In the example shown, the restriction in cross-section of the guide duct is limited to its portion formed by the duct 51 of the bored cylinder 5.

Figure 5:
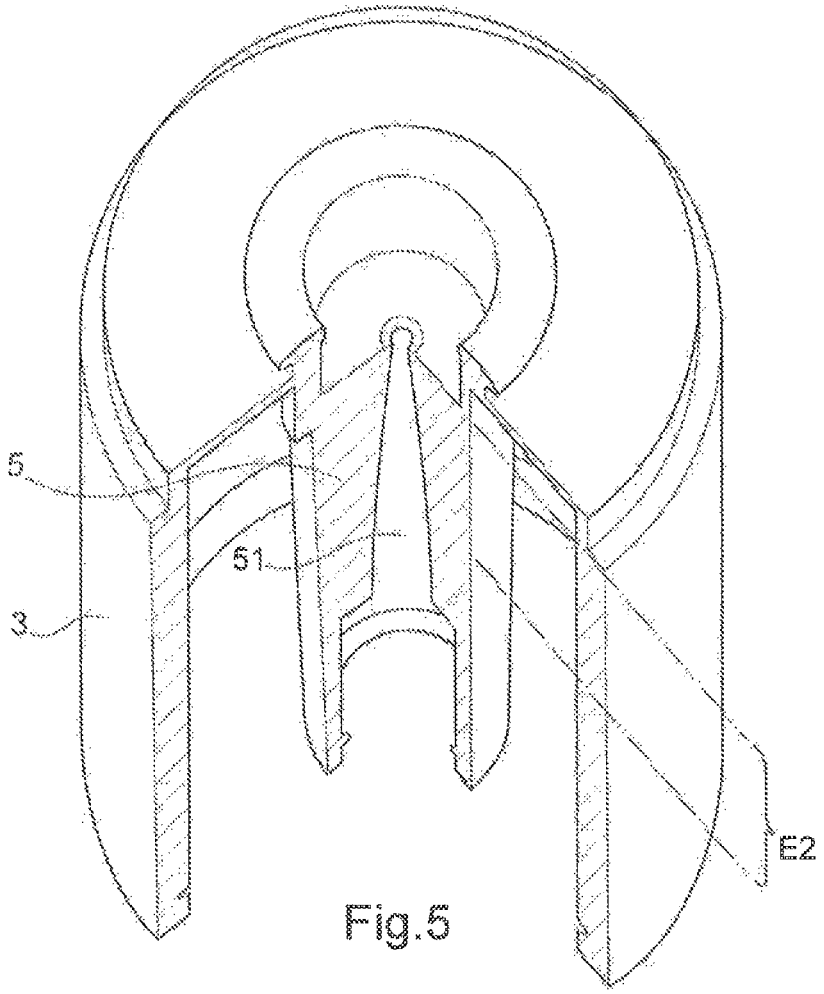
FIG. 5 represents an example of a second stage of a device for rupturing solid elements, in a truncated diagrammatic view in three dimensions.

FIG. 5 shows a three-dimensional view of the rotary body 3 and the bored cylinder 5 fastened thereto. The view is cut away so as to show the inside of those parts.

The restriction in cross-section forming the second stage E2 of the device for rupturing solid elements is progressive, and tends to compress the solid elements until they burst. Thus, the most restricted cross-section of the second stage, which here corresponds to the exit cross-section of the duct 51, is such that it does not allow passage without high deformation, leading to bursting of the solid elements B. For example, the maximum dimension of the most restricted cross-section of the second stage (that is to say its diameter if the restriction is circular, major axis diameter if it is elliptical, etc.) is less than the diameter of the solid elements if these are substantially spherical. For example, the most restricted cross-section (here the exit cross-section of the second stage E2) may be circular and have a diameter of 0.6 mm. The first stage may have a cross-section such that it can enable the passage of beads up to 0.8 mm diameter.

The beads for example have a diameter of the order of 1 mm, with potentially a certain dimensional dispersion.

The conjunction of the effects of the first stage E1 and of the second stage E2 enables bursting of a high number of solid elements. For example, if a solid element has its wall weakened but not ruptured by the first stage E1 the wall is easily burst by compression in the second stage due to its prior weakening. Furthermore, the solid elements present in the product may have a certain dispersion of their dimensions. The first stage E1 can in particular enable the rupture of the largest solid elements, while the second stage E2 enables the rupture of the smallest solid elements, which were not burst by the first stage E1. On account of the rupture of the largest elements in the first stage E1, the loss of pressure which would be linked to the obstruction of the restriction in cross-section of the second stage E2 by large solid elements is limited.

In the variant of the invention represented here, a non-return valve 91 is disposed between the outlet of the duct 51 and the application tip 4. The non-return valve 91 enables the product P contained in the device to be protected from the outside atmosphere. The non-return valve 91 also makes it possible, to a certain extent, to avoid the rotary body being actuated in the direction of rotation tending to suck back the product towards the inner barrel.

Figure 6:
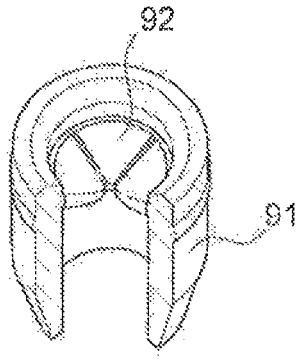
FIG. 6 represents an example of a non-return valve that can be implemented in some embodiments of the invention, in a truncated diagrammatic view, in three dimensions.

The non-return valve 91 can also assist in the bursting of the solid elements present in the product P prior to its dispensing. As a matter of fact, the non-return valve 91 can have a small exit cross-section, and, in some embodiments such as that shown in FIG. 6, membranes or fins 92 tending to close and burst the walls of the solid elements which in that case would have passed through the first and second stages of the device for rupturing solid elements without their wall bursting.

Advantageously, the non-return valve contributes to the general sealing of the dispensing device when the latter is in inverted position (application tip 4 oriented downward), for example in the handbag of a user.

The invention is particularly suited to the dispensing of a cosmetic or care product P in which a fluid is required to be released just prior to dispensing said product, for example a lip gloss, in which an ingredient is released to improve the gloss obtained.

The mechanism with a fixed piston and rotary body of the device described above is particularly well-suited to a device in accordance with the invention, since it enables easy control of the amount of product dispensed. Compared with a classic system with a pump, the risk of blockage of the pump by the product is eliminated.

On this principle, other mechanisms may be implemented, for example in which the rotary body comprises a part threaded on its inner surface, while the reservoir is linked to or comprises a ring having a corresponding male screw thread.

The invention may, generally, employ any type of mechanism enabling the expulsion of the product P via a guide duct in which are provided the two stages of a device for rupturing solid elements.

It is notable that the dispensing tip 4 may have various shapes, according to the type of product and the intended zone of application.

The dispensing tip 4 may have an application surface that is substantially conical, or substantially planar and inclined relative to the main axis (A) of the device, as in the example of FIG. 1, or for instance be dome-shaped.

The devices presented are in particular configured for the application of a lip gloss, more commonly designated by the term "gloss".

The invention thus developed provides a device enabling the dispensing of a cosmetic or care product stored in heterogeneous form, that is to say comprising solid elements. On account of the presence of at least two stages of a device for rupturing solid elements, disposed in series and not having any member of filter type liable to become clogged, the invention enables the rupture of a large proportion (or the entirety) of the solid elements present in the dispensed product, while limiting the risk of clogging compared with the devices known in the state of the art.

The invention claimed is:

1. A device for dispensing a liquid, semi-fluid or pasty cosmetic or care product stored in heterogeneous form comprising solid elements in suspension that can be ruptured mechanically to release a fluid they contain, comprising:

a reservoir configured to store the product;

a dispensing tip for dispensing the product;

a guide duct enabling transport of the product between the reservoir and the dispensing tip; and a product flow inducer configured to cause product flow from the reservoir to the tip, via the guide duct, the guide duct comprising a solid elements rupturer configured to rupture the solid elements;

the the solid elements rupturer comprising a first stage, at an exit from the reservoir, forming a first portion of the guide duct and comprising a changing transverse cross-section having at an exit edges projecting within said guide duct; and a second stage, near the dispensing tip, forming a second portion of the guide duct and having a progressive restriction of cross-section.

2. A device according to claim 1, further comprising:

downstream of the second stage of the solid elements rupturer, a non-return valve.

3. A device according to claim 2, wherein:

the non-return valve has an outlet mouth having a cross section less than an exit cross-section of the first stage and less than a most restricted cross section of the second stage.

4. A device according to claim 1, wherein:

the exit cross-section of the first stage is star-shaped.

5. A device according to claim 1, wherein:

the restriction of cross-section of the second stage is a restriction comprised between 50% and 95% of an area of an entry cross section of the second stage.

6. A device according to claim 1, wherein:

the second portion of the guide duct, formed in the second stage of the solid elements rupturer, has a conical frustum shape.

7. A device according to claim 1, further comprising:

an elongate hollow rotary body and an elongate hollow outer barrel that are butted to each other, and rotatable in relation to each other;

the dispensing tip being fastened at an end of the rotary body;

the rotary body and outer barrel forming an inner volume in which are provided a bored cylinder, comprising the guide duct; and an inner barrel comprising:

an open end in which the bored cylinder is inserted; and a closed end forming the reservoir;

the device further comprising a rotation transformer configured to transform rotation of the rotary body in relation to the outer barrel into a translational movement of the inner barrel in relation to the bored cylinder inside the inner volume formed by said rotary body and outer barrel.

8. A device according to claim 7, further comprising:

a piston fixedly mounted at one end of the bored cylinder inserted through the open end of the inner barrel and comprising an elongate portion forming the first portion of the guide duct in the bored cylinder, in which the piston comprises a central opening forming the first stage of the solid elements rupturer.

9. An assembly comprising a device according to claim 1, and a cosmetic or care product comprising solid elements in suspension configured to be ruptured mechanically to release a fluid they contain, said cosmetic or care product being stored in the reservoir of the device.

10. An assembly according to claim 9, wherein:

the solid elements are substantially spherical beads of diameter more than a maximum dimension of a most restricted cross section of the second stage.

* * * * *